US006519979B2

(12) United States Patent
Freedman

(10) Patent No.: US 6,519,979 B2
(45) Date of Patent: Feb. 18, 2003

(54) OTTOMAN RIBBED EFFECT FABRIC USING CORE SPUN ELASTOMERIC YARN AND OTHER FIBERS

(76) Inventor: Stanton A. Freedman, #1 Grove Isle Dr., Apt. 1007, Miami, FL (US) 33133

( * ) Notice: Subject to any disclaimer, the term of this patent is extended or adjusted under 35 U.S.C. 154(b) by 12 days.

(21) Appl. No.: 09/844,719

(22) Filed: Apr. 27, 2001

(65) Prior Publication Data

US 2002/0112510 A1 Aug. 22, 2002

Related U.S. Application Data

(60) Provisional application No. 60/270,708, filed on Feb. 22, 2001.

(51) Int. Cl.[7] ..... D04B 15/54
(52) U.S. Cl. ..... 66/142
(58) Field of Search ..... 66/169 R, 170, 66/171, 172 E, 196, 200, 202

(56) References Cited

U.S. PATENT DOCUMENTS

| | | | | | |
|---|---|---|---|---|---|
| 3,392,552 | A | * | 7/1968 | Muller et al. | 66/169 R |
| 3,971,234 | A | * | 7/1976 | Taylor | 66/172 E |
| 4,561,267 | A | * | 12/1985 | Wilkinson et al. | 66/172 E |
| 4,872,324 | A | * | 10/1989 | Rearwin et al. | 66/172 E |
| 5,033,276 | A | * | 7/1991 | Strauss et al. | 66/196 |
| 5,050,406 | A | * | 9/1991 | Strauss et al. | 66/177 |
| 5,119,644 | A | * | 6/1992 | Strauss et al. | 2/79 |
| 5,198,288 | A | * | 3/1993 | Grunfeld | 442/306 |

* cited by examiner

*Primary Examiner*—Danny Worrell
(74) *Attorney, Agent, or Firm*—Akerman Senterfitt & Edison, P.A.; Michael C. Cesarano

(57) ABSTRACT

A non-elastic yarn is knitted with a core spun elastomeric yarn in a ratio of ends of non-elastic yarn to ends of core spun elastomeric greater than 2:1 to create a knitted fabric having a ridged surface that permits air to pass between the ridges.

5 Claims, 6 Drawing Sheets

OTTOMAN RIBBED EFFECT FABRIC USING CORE SPUN ELASTOMERIC YARN AND OTHER FIBERS

This application claims the benefit of U.S. provisional application No. 60/270,708, filed Feb. 22, 2001.

Articles of apparel and fabrics made using spandex knitted fabrics (developed and sold by duPont under the name LYCRA™) have long been popular because of their close fit, expandability, and comfort. Spandex is an elastomeric man-made fiber having elastic qualities generally considered superior to those of rubber, which it has largely replaced. In many such fabrics spandex is used along with other natural or man made fibers to create a fabric that is not only stretchable, but may also have the desirable characteristics of wrinkle-resistance and washability.

An elastic yarn may consist solely of a number of elastomeric fibers combined to make a "bare" elastomeric yarn, such as spandex, or the yarn may use the elastic strand as a monofilament core in a composite yarn having inelastic staple fibers as an outer covering. A yarn such as this is said to be "core spun." A number of advantages have been found to using core spun elastomeric yarn in fabrics. Among these advantages are appearance, improved handling characteristics, shrinkage control, protection of the core against perspiration and grease, color fastness, control over elongation, and greater power of recovery. Some of these benefits are noted by Humphreys in U.S. Pat. No. 3,017,740. In addition, the outer covering, which may be composed of natural fibers such as cotton, manmade fibers such as polyester, or a combination of both, provides additional breathability to fabrics in which it is used, as contrasted with fabrics made using a bare elastomeric yarn.

Although knitted fabric using bare spandex has recently been introduced into the market for bed sheets, and particularly bed sheets for use in hospitals and other health care facilities, knitted bed sheets and other coverings using core spun elastomeric yarns have not previously been used. The use of bare spandex in the hospital sheet environment is described in U.S. Pat. No. 6,164,092 to Menaker, who notes that a stretchable bed sheet enjoys a number of benefits, including easier installation on a mattress, resilience during repeated washings, and resistance to "brunching up" under a patient. Menaker describes a knitted bed sheet in which the elastomeric yarn will have a 1-to-1 ratio with poly-cotton yarn, and will constitute between 0.01% and 10% of the weight of the finished material. That is, even though the substantial weight of the finished sheet will be accounted for by non-elastic natural or man made fibers, there will be one strand of elastomeric yarn for each strand of non-elastic yarn used in the fabric.

While Menaker's use of bare spandex in bed sheets signifies an improvement over the prior art, there are some drawbacks associated with the use of bare spandex in such fabrics. For example, bare spandex is knitted under tension so that the fabric will naturally assume a desired shape when it is relaxed. This places the bare spandex yarn under modest tension even when the fabric is not being stretched. As a result of this modest tension, if a spandex yarn should break, the broken ends will pull away from the break, causing localized fraying and resulting in the two loose ends obtruding from the fabric. In a hospital or health care setting, the common use of safety pins, clips, and other fasteners to hold tubes, bed adjustment controls, and television remote control units in proximity to a patient may make holes in a bed sheet that exacerbates the breakage problem which then becomes further exacerbated by the frequent washings to which hospital sheets are subjected. Another drawback to Menaker's knitted bed sheet is its relative lack of breathability when applied in a snug fit over a liquid and air impermeable hospital mattress cover or other non-breathable surface.

Thus, there is a need for a breathable knitted fabric for use in covering impermeable materials such as hospital mattresses and that will not exhibit fraying or obtruding strand ends when yarn breakage occurs through normal usage of the article.

This invention uses a core spun elastomeric yarn to overcome the problems encountered with a bare elastomeric yarn. A core spun elastomeric yarn provides protection for an elastomeric core within the outer covering and will tend to keep the elastomeric core from breaking, should a sharp implement penetrate the fabric. Even if the elastomeric filament in the core should become broken, the outer covering will hold the two broken ends in proximity to one another, and will prevent them from withdrawing from the site of the break. By maintaining the integrity of the yarn and the fabric, the core spun elastomeric yarn will prevent the fraying at the point of breakage that is found to occur with a bare elastomeric yarn.

In addition, a core spun elastomeric yarn can be knitted into a fabric so as to present a smooth surface on one side and a ridged, or ottoman effect on the opposite side. This may be done by adjusting the ratio of ends of core spun elastomeric yarn to ends of inelastic yarn and by adjusting the sizes of the respective yarns. When a smaller size inelastic yarn is used with a large size core spun elastomeric yarn in a 3:1 ratio, a fabric that is smooth on one side and ridged on the other is produced. If the ridged side is placed next to an impermeable surface, the ridges act as pillars to hold the fabric away from the impermeable surface and promote airflow beneath and through the knitted fabric.

Color permeation is also improved with a core spun elastomeric yarn. Because a bare elastomeric yarn may not hold color well, prints and other colored knit fabrics using a bare elastomeric yarn may show minute white spots or discolorations in which the bare elastomeric yarn is visible and has not taken on the same color as surrounding fibers. However, a core spun elastomeric yarn will not exhibit this flaw since the outer covering is made of a staple fiber that will hold whatever color was imparted into the surrounding fibers.

The outer covering of a core spun elastomeric yarn may also provide control for the elasticity and power of recovery of fabrics made from core spun elastomeric yarn. When the yarn is stretched, the outer covering may reach the limit of its extension before the elastomeric monofilament has reached its extreme limit. Such a fabric will reach its maximum stretch length upon the application of modest tension while still maintaining its full power of recovery. These and other benefits of a fabric using a core spun elastomeric yarn will be more fully explained in the following description of the invention.

DESCRIPTION OF THE PREFERRED EMBODIMENTS

Figure 1A:
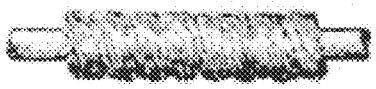
FIG. 1 depicts a typical core spun elastomeric yarn in a relaxed state (FIG. 1*a*) and under tension (FIG. 1*b*).
Figure 1B:
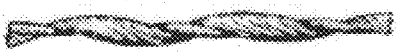

In FIG. 1*a*, a core spun elastomeric yarn 10 is shown in a relaxed state. An inner elastomeric filament 20 is encased in an outer covering material 30 that may be made from a natural fiber, a man made fiber, or a combination of both. When relaxed, the outer covering will have a loose winding through which air may pass to make the fabric more breathable. FIG. 1*b* shows the core spun elastomeric yarn in a state of tension. As shown, the non-elastic outer covering fibers 30 are stretched to their maximum. Although the air spaces between the fibers of the outer covering have been eliminated, the overall diameter of the yarn has decreased under tension, thus permitting air to pass around the outer covering.

Figure 2:
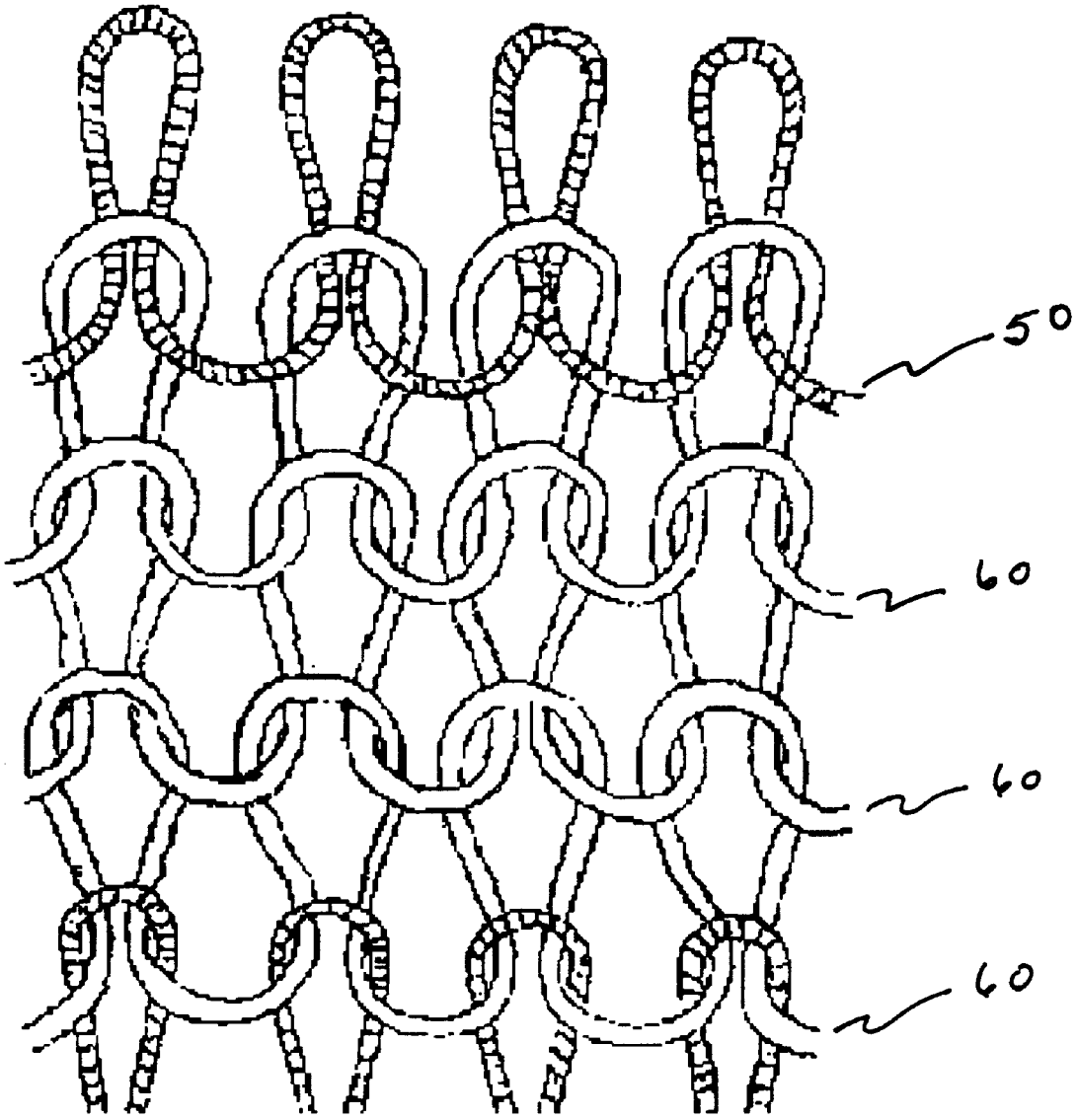
FIG. 2 depicts a knitted fabric using a core spun elastomeric yarn in which the ratio of non-elastic ends to elastomeric ends is 3-to-1.

FIG. 2 shows a typical knitting pattern in which one end of spun core elastomeric yarn 50 is used for every three ends of non-elastic yarn 60. In FIG. 2, the fabric is shown in a relaxed state, and the yarns are of approximately the same sizes. While any ratio of core spun elastomeric yarn to non-elastic yarn may be used, a ratio ranging from between 3:1 to 6:1 will provide a fabric with ideal elasticity while retaining its shape throughout repeated uses and washings. Because the stretch length of a core spun yarn is ultimately limited by the length of the outer covering when taut, fewer ends of a core spun elastomeric yarn are required to obtain desired stretch characteristics than would be required for a fabric using a bare elastomeric yarn. The use of a 3:1 end ratio does not suggest that the weight of the elastomeric filament bears a similar ratio to the weight of non-elastic fibers in the finished fabric. By adjusting the size of the non-elastic ends, the amount of non-elastic fiber used in the outer coating, and the size of the elastomeric filament, any desired ratio of non-elastic fiber to elastomeric fiber may be obtained within reasonable limits.

The ability to control the amount of stretch and power in a fabric is particularly important when the fabric is to be used as bed sheeting for hospitals and health care facilities. While complications resulting from the use of conventional, non-stretch sheets, are well known, and include the formation of ulcers and bed sores on patients' bodies, there are also drawbacks associated with the use of bed sheets whose elasticity is too great. One of these is the drawback that such a sheet will allow too much "give," and provide little or no support, when subjected to localized forces such as a patient's attempting to support his or her upper body upon an elbow, or when the patient pushes downward with one or both hands or feet in an attempt to adjust his or her body position.

Figure 3:
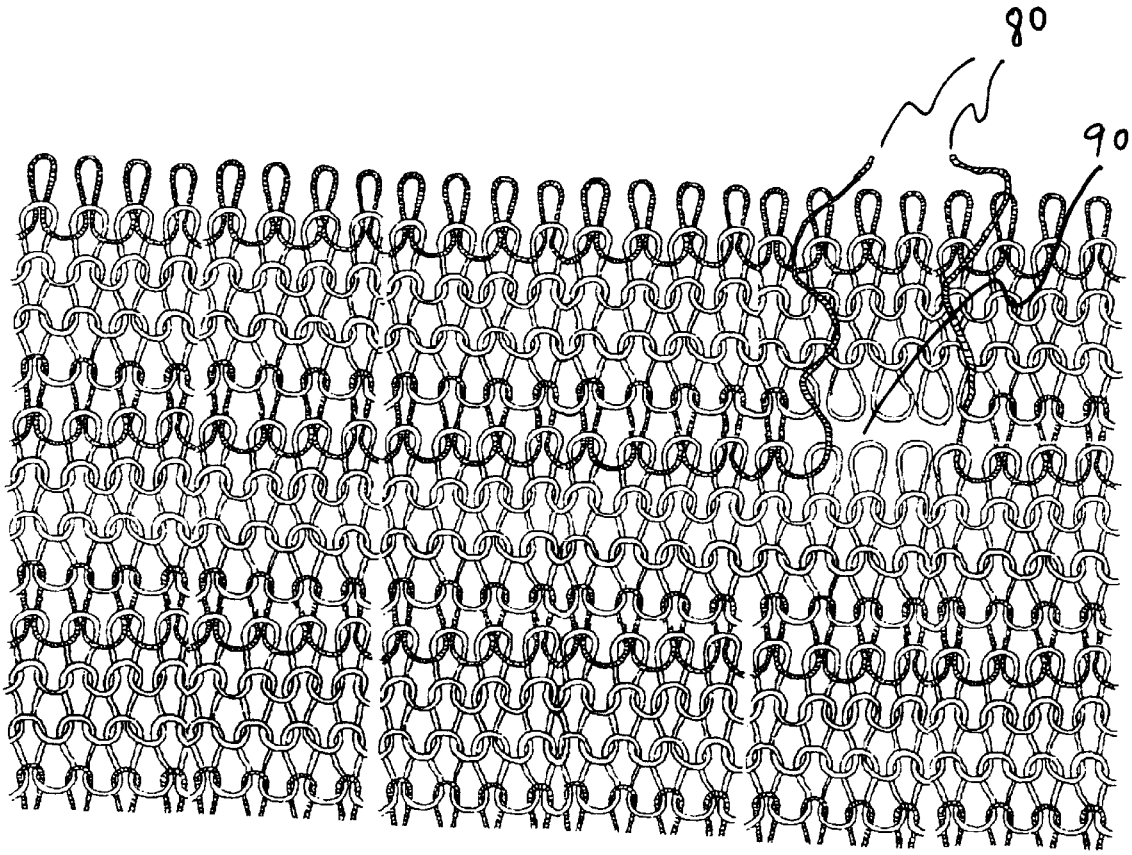
FIG. 3 shows a knitted fabric using a bare elastomeric yarn in which an elastomeric end has been broken.

FIG. 3 depicts a fabric 70 using a bare elastomeric yarn in which the elastomeric filament has become broken. As is shown, the ends 80 of the bare elastomeric yarn have pulled away from each other and are obtruding from the fabric. At this point, other yarns in the knit 90 have lost a supporting yarn and the surrounding fabric is subject to fraying and degradation.

The fraying and obtruding ends seen in FIG. 3 will not occur in the fabrics of this invention. Rather, if the elastomeric filament should break, the outer covering will remain intact, keeping the broken ends of the elastomeric filament in proximity to one another, and maintaining the integrity of the yarn and the fabric. Because the surrounding yarns have not lost the support provided by the core spun elastomeric yarn, there is no fraying or degradation of the sheet fabric.

Figure 4:
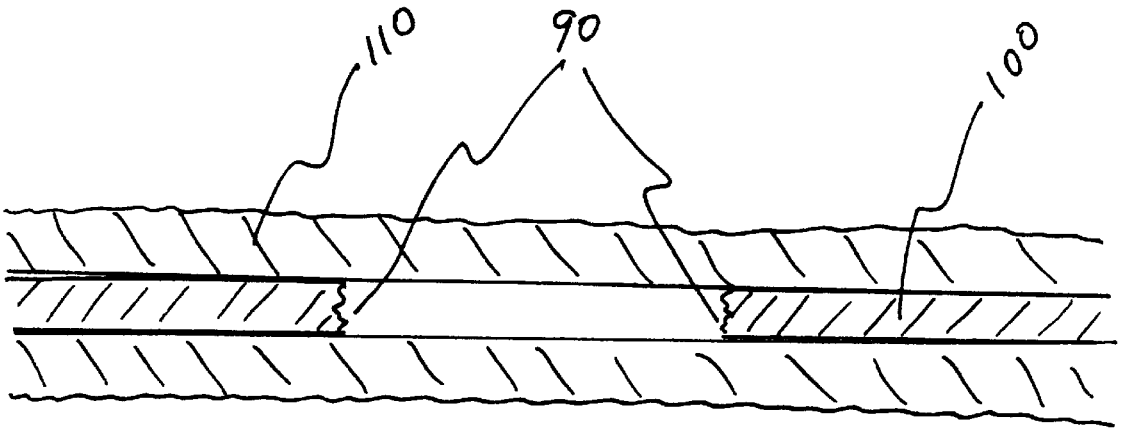
FIG. 4 is a sectional diagram showing a core spun elastomeric yarn in which the elastomeric filament has broken.

FIG. 4 illustrates a cross section of a core spun elastomeric yarn in which the elastomeric filament 100 has broken. As can be seen, the broken ends 90 have pulled slightly apart, but have been maintained in proximity to each other within the outer covering 100. Because the covering remains intact, the yarn will continue to support surrounding yarns, and the overall integrity of the sheet fabric is maintained.

Figure 5:
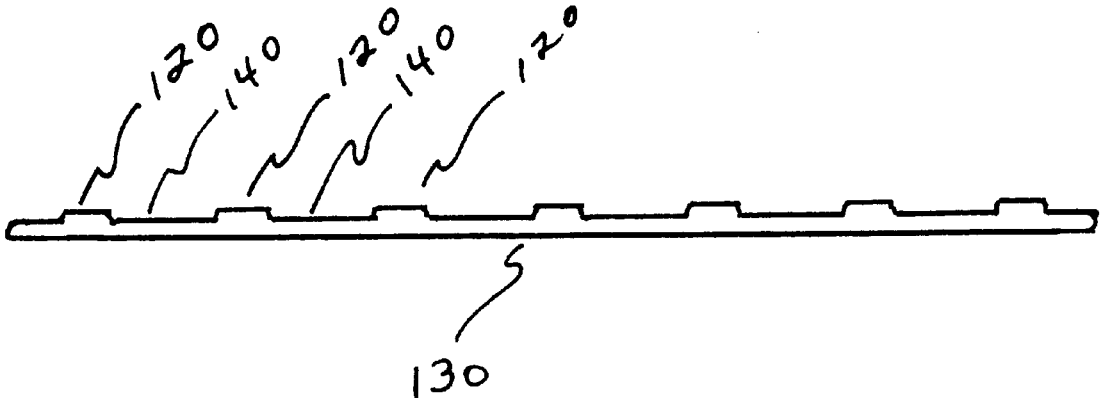
FIG. 5 depicts a cross sectional view of a fabric that is ridged on one side and smooth on the other.
Figure 6:
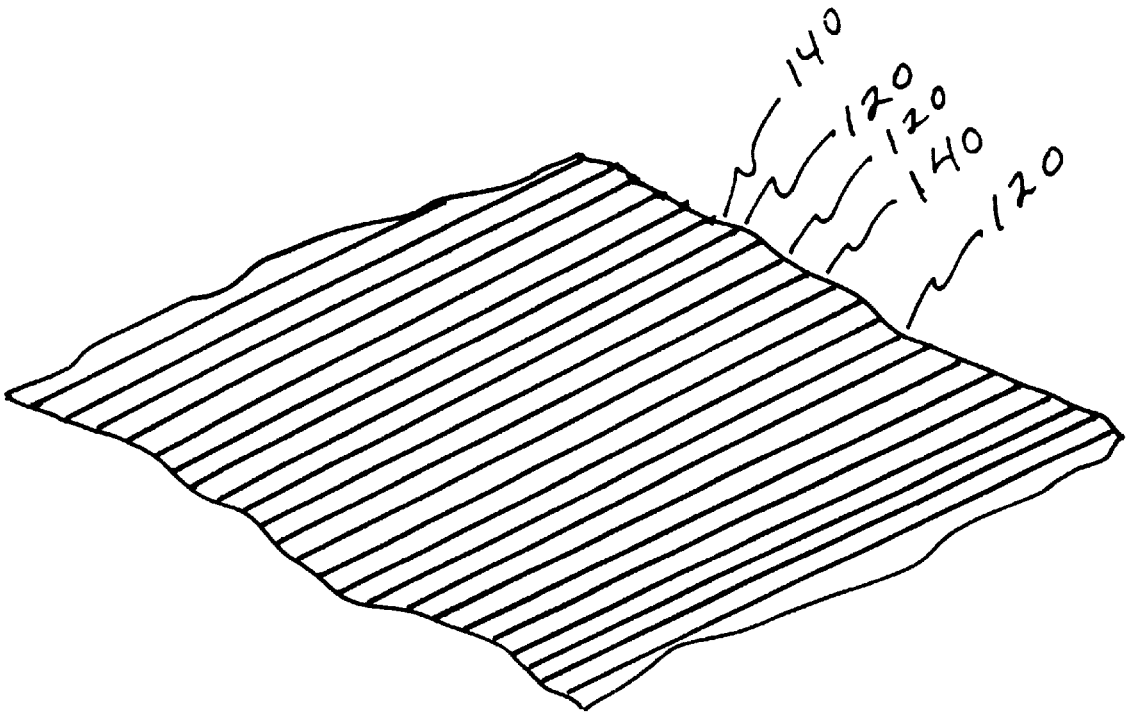
FIG. 6 shows the ridged effect that is produced in the fabric of this invention.

FIG. 5 depicts a sectional view of a fabric having a 3:1 ratio of inelastic yarn to core spun yarn in a fabric in which the there is a differential in the sizes of the yarns used in the fabric. That is, the core spun elastomeric yarn has a size that is nearly twice as large as that of the inelastic yarn. Because the larger core spun elastomeric yarn has a size that is larger than the smaller inelastic yarn, an ottoman rib effect 120 is created on one side of the fabric each third knitting row. The opposite surface of the fabric 130 is smooth. The effect of the ridges on one side of the fabric is to act as pillars or to provide a catamaran effect to hold the inelastic yarn away from the surface of any object that touches the ridges. The fabric that is held away from the surface of the object creates a channel 140 through which air may pass. In this manner, when the knitted fabric of this invention is used on a mattress or other object having an impermeable surface, air will pass through the channels to reach points located away from the edges of the fabric, and will then pass through the fabric, causing the fabric to be "breathable." The overall effect of using a 3:1 or greater ratio of inelastic yarn to core spun elastomeric yarn is shown in FIG. 6, in which a ridged pattern is clearly visible on the side of the fabric having ridges 120 and channels 140. Although the ridged effect depicted in FIG. 6 can be produced using inelastic and core spun elastomeric yarns in different ratios, such as 4:1 or 2:1, a ratio of 3:1 has been found to provide a channel of sufficient width to provide adequate breathability while the opposite surface of the fabric presents a smooth surface. In this embodiment, the core spun elastomeric yarn may have a size that is approximately twice the size of the elastomeric yarn. In the event that larger ridges are desired, that effect may be accomplished by using a core spun elastomeric having a larger size, or by using an elastic yarn having a smaller size, or both. If smaller ridges are desired, a smaller size core spun elastomeric yarn, or a larger size inelastic yarn, or a combination of both, may be used.

While the description of this invention relates to fabrics to be used as coverings over impermeable surfaces, it may be seen that this fabric may have other uses in circumstances in which it is desirable to establish and maintain breathability of the fabric, or where a limited stretch is desired. Although specific references have been made to bed sheeting, the fabric of this invention is not so limited, and persons of ordinary skill in the art will understand that various combinations of yarn size and ratio of inelastic yarn to core spun elastomer yarn may be employed to create fabrics having other uses, and that such fabrics are within the essence and scope of this invention.

I claim:

1. A knitted bedsheet comprising:

A core spun elastomeric yarn and a non-elastic yarn, said core spun elastomeric yarn being knitted with said nonelastic yarn whereby the ratio of ends of non-elastic yarn to ends of core spun elastomeric yarns in said knitted bedsheet is greater than 2:1, said core spun elastomeric yarn being greater in size than said non-elastic yarn, such that said knitted bedsheet has ridges on one side and has a smooth surface on the opposite side.

2. The knitted bedsheet of claim 1 in which said ratio of ends of non-elastic yarns to ends of core spun elastomeric yarns in said knitted bedsheet is between 3:1 and 6:1.

3. The knitted bedsheet of claim 2 in which the size of said core spun elastomeric yarn is more than one and one-half times the size of said non-elastic yarn.

4. The knitted bedsheet of claim 2 wherein said ridges are spaced apart a sufficient distance to permit air to pass within the space defined by said ridges.

5. The knitted bedsheet of claim 5 wherein, when said surface of said bedsheet having ridges is placed adjacent to a second surface, said ridges hold a portion of said fabric away from said second surface.

* * * * *